US005690401A

United States Patent [19]

Franklin

[11] Patent Number: 5,690,401

[45] Date of Patent: Nov. 25, 1997

[54] LOCKER DRESSER

[76] Inventor: Randolph C. Franklin, 4117 Woodlawn Ave., Los Angeles, Calif. 90011

[21] Appl. No.: 719,125

[22] Filed: Sep. 24, 1996

[51] Int. Cl.[6] ..... A47B 87/00

[52] U.S. Cl. ..... 312/107; 312/293.2

[58] Field of Search ..... 312/107, 108, 312/111, 249.1, 311, 291, 293.1, 293.2

[56] References Cited

U.S. PATENT DOCUMENTS

| | | | |
|---|---|---|---|
| 2,330,044 | 9/1943 | Gaston | 312/293.2 |
| 2,360,452 | 10/1944 | Stone | 312/293.2 |
| 3,473,372 | 10/1969 | Ruggerone | 312/108 |
| 4,423,913 | 1/1984 | Lee | 312/111 |

*Primary Examiner*—Peter M. Cuomo
*Assistant Examiner*—Gerald A. Anderson

[57] ABSTRACT

A dresser to be contained in a clothing locker, the dresser being formed of two independent units with each of the units having one or more sliding drawers, and with each of the units having a rectangular shape and dimensioned to be fitted together in side-by-side relationship within the locker to form a detachable assembly having an overall width corresponding to the internal width of the locker and an overall height substantially less than the internal height of the locker. The facing sides of the two units are shaped to provide mating latches which serve to hold the two units in an assembled interlocked position within the locker. The dresser has a frame surrounding its front side, and the dresser is held in the locker by the frame.

4 Claims, 3 Drawing Sheets

LOCKER DRESSER

BACKGROUND OF THE INVENTION

Military and law enforcement personnel are usually provided with lockers for their clothing, uniforms and gear. The primary objective of the present invention is to provide a dresser which may be inserted into such a locker in a disassembled state and then assembled. The dresser is provided with drawers in which clothing and other personal items may conveniently be placed.

It is, accordingly, an objective of the present invention to provide a dresser that is specifically constructed for use in lockers of the type used, for example, by military and law enforcement personnel. Another objective of the invention is to provide such a dresser that is light, sturdy and stable and capable of long-time use.

The dresser of the invention is formed of a plurality of separate independent units, each of which contains at least one sliding drawer. The units may be quickly and easily assembled into a rectangular dresser after being to be inserted into the locker. The dresser also may be quickly and easily disassembled in the locker, and the separate units conveniently transported from place to place as the personnel are transferred from one location to another.

Briefly stated, a general objective of the present invention is to provide a light, yet durable dresser, which is composed of separate units and which is constructed to fit into standard lockers of the type used, for example, by military and law enforcement personnel.

Appropriate latches, or other means, are provided for interlocking the units of the dresser of the invention, when the dresser is assembled after the units have been placed in the locker.

The dresser of the invention is preferably formed of an appropriate plastic material to make it light in weight and yet sturdy and durable and capable of withstanding the jarring and stress of frequent moving.

SUMMARY OF THE INVENTION

The presently preferred embodiment of the dresser of the present invention is an assembly composed of two units which are individually placed in the locker and then coupled together to be adjacent to one another and retained in place by the frame of the locker which surrounds the open front. In the preferred embodiment the two units each has two drawers positioned vertically over one another, and a single wide lower drawer is contained in both units. The two units are configured so that they form mating latches to enable the units to become latched to one another when one is moved down with respect to the other into position adjacent to one another. The resulting dresser has a width corresponding to the internal width of the locker, and a height which is substantially less than the overall height of the locker. In such a manner, the dresser of the invention is adapted to fit into a standard locker of the type used by military and law enforcement personnel. As stated above, the assembled dresser is held in place in the locker by the standard frame of the locker which circumscribes the open front of the locker which may be closed by a usual door.

DETAILED DESCRIPTION OF THE ILLUSTRATED EMBODIMENTS

Figure 1:
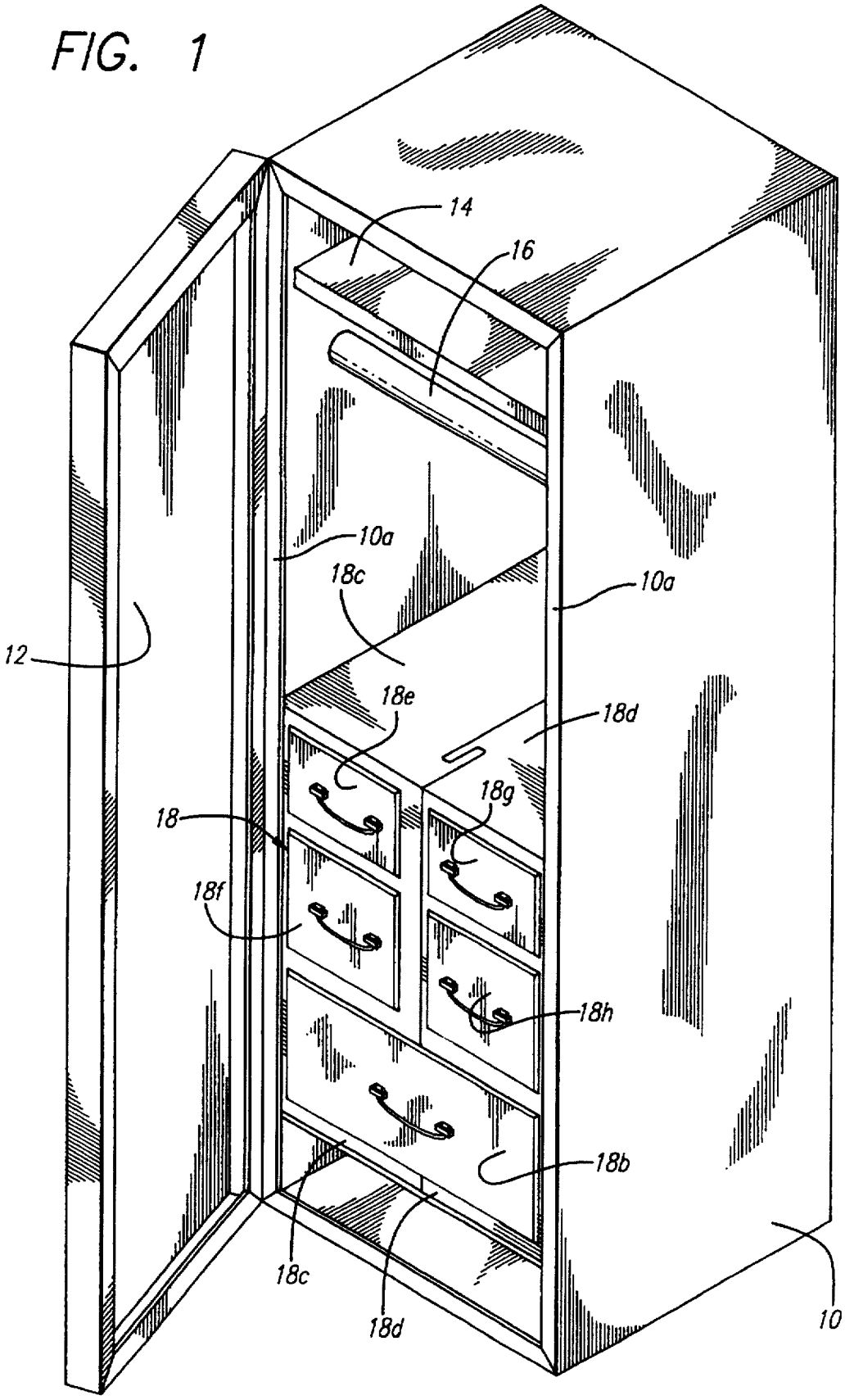
FIG. 1 is a perspective representation of a typical clothing locker, showing a dresser constructed of two independent units and which incorporates the teachings of the present invention and which is contained in the locker.

The representation of FIG. 1 includes a typical military or police clothing locker 10 which is equipped with a door 12 at its front end. The front end of the locker is circumscribed by a usual frame 10*a*. A shelf 14 is mounted in the locker near the top, and a hangar bar 16 is mounted under the shelf.

Figure 2:
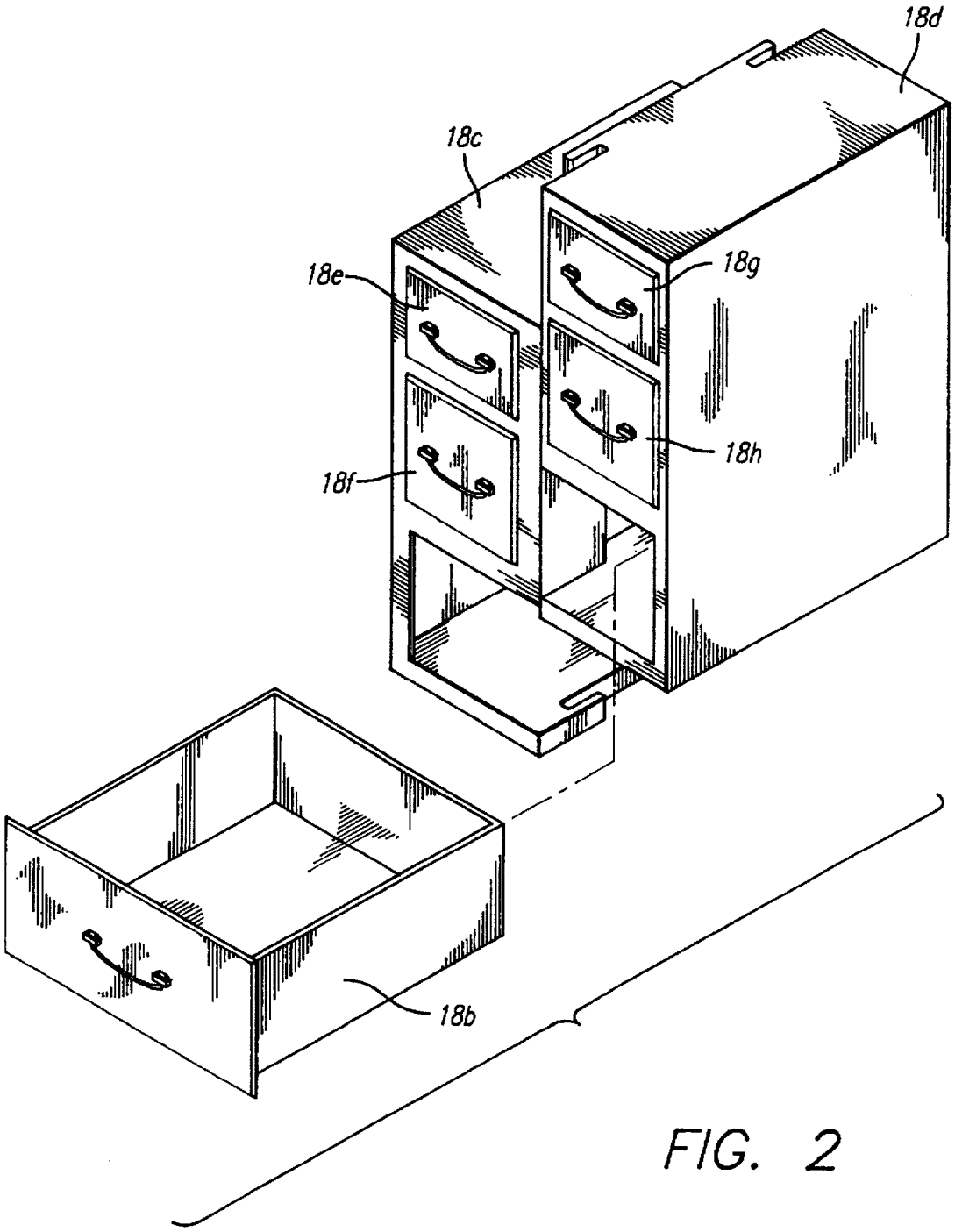
FIG. 2 is a perspective view of the dresser of FIG. 1 as it is being assembled within the locker, with one of the units being moved down adjacent to the other unit in latching engagement with the other unit.

In accordance with the invention, a dresser 18 is supported in the locker 10 and is held in place within the locker by the frame 10*a*. The dresser 18 is made up of two separate units 18*c* and 18*d* which, together, have a width corresponding to the internal width of the locker itself. A single lower drawer 18*b* is slidably mounted in the units 18*c* and 18*d*. The two units 18*c* and 18*d* are supported adjacent to one another, and their facing sides are shaped, as shown, to provide mating latches so that the two units may be firmly interlocked with one another. Two drawers 18*e* and 18*f* are slidably supported one above the other in unit 18*c*, and two drawers 18*g* and 18*h* are slidably supported one above the other in unit 18*d*. To place the dresser 18 in the locker 10, the unit 18*c* is first placed in the locker and moved against the side of the locker behind the frame 10*a*. The second unit 18*d* is then placed in the locker above unit 18*a* and to one side, and is moved down into position adjacent to the unit 18*c*, as shown in FIG. 2. The facing sides of the units 18*c* and 18*d* are configured to form mating latches, so that when the unit 18*d* is moved down adjacent to unit 18*c*, the two units are firmly interlocked with one another.

Accordingly, the dresser 18 of the invention may be conveniently assembled into the configuration shown in FIG. 1, after it has been placed in the locker. When assembled, the dresser 18 is held in the locker by frame 10*a*. When the time comes to remove the dresser from the locker, one of the units 18*c* and 18*d* is moved upward until it clears the other unit, and the units may then be separated and removed from the locker. Obviously, before this operation takes place, the drawers 18*b*, 18*e*, 18*f*, 18*g* and 18*h* are removed.

Figure 4:
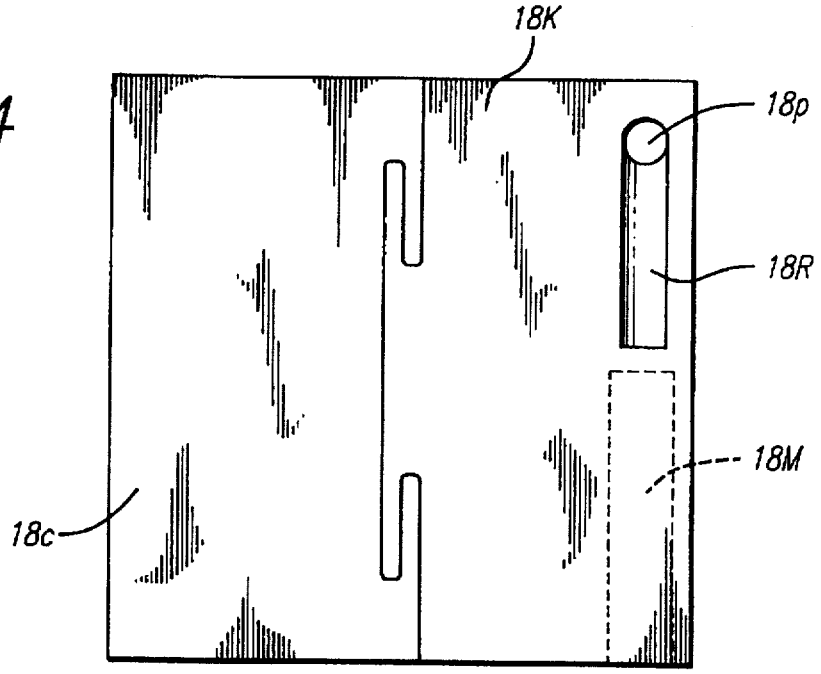
FIG. 4 is a top plan view of the embodiment of FIG. 3.
Figure 3:
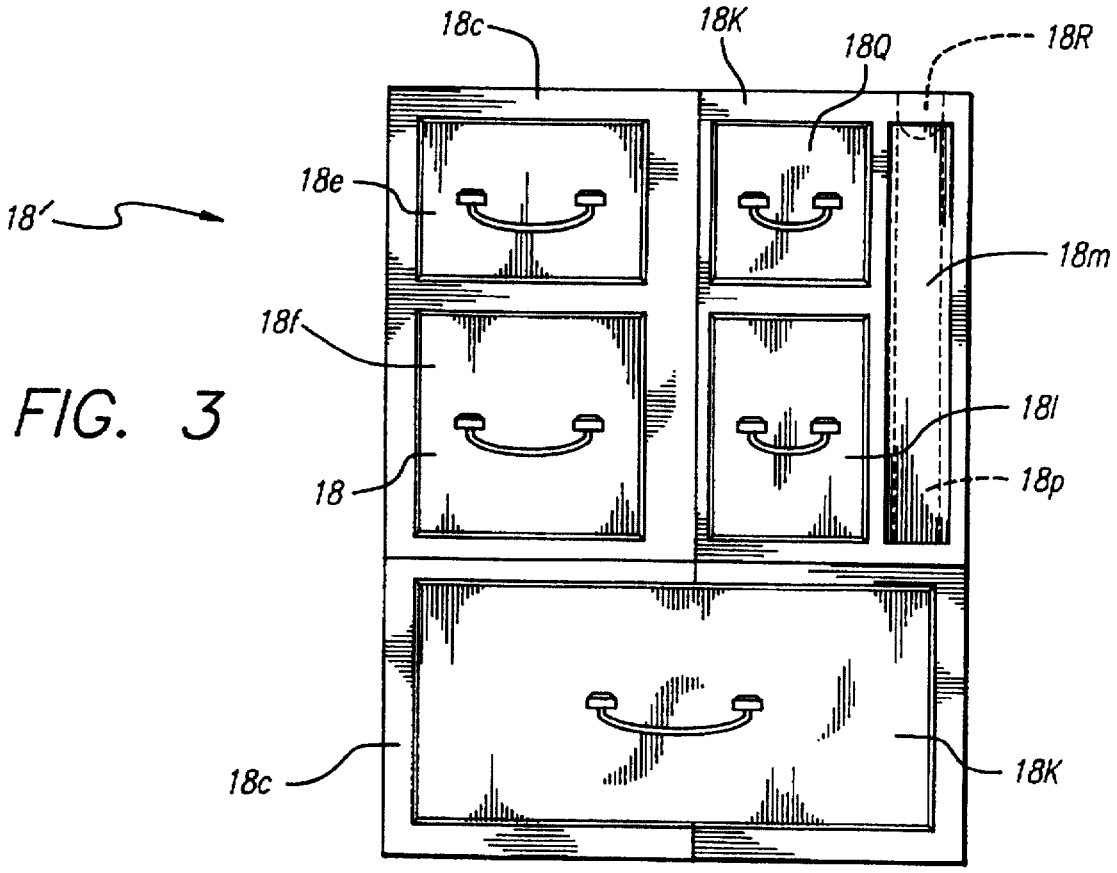
FIG. 3 is a front elevational view of a second embodiment of the invention.

The dresser 18' shown in FIGS. 3 and 4 is similar in most respects to the dresser 18 of FIG. 1, and like elements have been designated by the same numbers. In the embodiment of FIGS. 3 and 4, the unit 18*d* of FIG. 1 has been replaced by a unit 18*k* which contains two drawers 18*q* and 18*l* positioned one above the other. The drawers 18*q* and 18*l* are somewhat narrower than the drawers 18*g* and 18*h* of FIG. 1, and a slot 18*m* is provided to those drawers in the front of the unit 18*k* for receiving folders, clipboards and the like. Also, a well 18*p* is provided at the top of the unit for receiving a baton, or the like, normally carried by police officers. A shallow indentation 18*r* is provided in the top surface of unit 18*k* for receiving the handle of the baton.

As shown in FIG. 4, the adjacent edges of units 18*c* and 18*k* are formed with interlocking members, similar to the units described above in conjunction with FIGS. 1 and 2, so that units 18*c* and 18*k* may be latched securely together in the manner described above.

The invention provides, therefore, a dresser formed of two separate units which may be quickly assembled and latched together after insertion into a clothing locker. The dresser also may be easily disassembled and removed from the clothing locker when so desired.

It will be appreciated that while particular embodiments of the invention have been shown and described, modifications may be made. It is intended in the claims to cover all modifications which come within the true spirit and scope of the invention.

I claim:

1. In combination, a dresser and a clothing locker, said clothing locker having a particular internal width and a particular internal height, said dresser comprising a pair of separate units, a single sliding lower drawer mounted said units, and each of said units having a front, a bottom, a top, first and second sides, and a rectangular shape, and said units being dimensioned to be fitted together to form an assembly having an overall width corresponding to the internal width of the locker and an overall height substantially less than the internal height of the locker, said units being supported in side-by-side relationship to have facing sides and also to have an overall width corresponding to the internal width of said locker, and the facing sides of said units being shaped to form mating latches to cause said units to be interlocked to one another as one of the units is moved down into side-by-side relationship with the other of the units.

2. The unit defined in claim 1, and which includes two additional sliding drawers mounted one above the other in each of said units above said lower drawer.

3. The dresser defined in claim 2, in which the additional drawers in one of said units are displaced from one of the sides thereof, and said one of said units has a well formed therein extending down from the top thereof for receiving a baton.

4. The dresser defined in claim 2, in which the additional drawers in one of said units are displaced from one of the sides thereof, and said one of said units has a slot formed therein extending inwardly from the front thereof for receiving papers, clipboards and the like.

* * * * *